US009242133B2

(12) United States Patent
Newman

(10) Patent No.: US 9,242,133 B2
(45) Date of Patent: Jan. 26, 2016

(54) EXERCISE RING WITH FALSE GRIP ASSISTANCE

(71) Applicant: David R. Newman, El Cajon, CA (US)

(72) Inventor: David R. Newman, El Cajon, CA (US)

( * ) Notice: Subject to any disclaimer, the term of this patent is extended or adjusted under 35 U.S.C. 154(b) by 0 days.

(21) Appl. No.: 14/590,859

(22) Filed: Jan. 6, 2015

(65) Prior Publication Data

US 2015/0126334 A1 May 7, 2015

Related U.S. Application Data

(63) Continuation-in-part of application No. 14/047,630, filed on Oct. 7, 2013.

(60) Provisional application No. 61/719,251, filed on Oct. 26, 2012.

(51) Int. Cl.
*A63B 7/02* (2006.01)

(52) U.S. Cl.
CPC ..... *A63B 7/02* (2013.01); *A63B 21/4035* (2015.10); *A63B 21/4039* (2015.10)

(58) Field of Classification Search
CPC ..... A63B 21/00
USPC ..... 482/49, 106, 108
See application file for complete search history.

(56) References Cited

U.S. PATENT DOCUMENTS

| | | | | |
|---|---|---|---|---|
| 2,584,537 | A | 2/1952 | Benfield | |
| 5,435,800 | A | 7/1995 | Nelson | |
| 5,445,582 | A | 8/1995 | Brown | |
| 5,681,243 | A * | 10/1997 | Criss | 482/49 |
| 6,361,480 | B1 * | 3/2002 | Coram | 482/83 |
| 6,446,483 | B1 | 9/2002 | Ericksen | |
| 7,037,240 | B2 * | 5/2006 | Pemberton | 482/49 |
| 7,819,789 | B2 | 10/2010 | Berman et al. | |
| 8,684,889 | B1 | 4/2014 | Berrisford | |
| 2011/0136633 | A1 * | 6/2011 | Riggs et al. | 482/121 |
| 2011/0287903 | A1 * | 11/2011 | Mathews | 482/93 |

FOREIGN PATENT DOCUMENTS

| | | | |
|---|---|---|---|
| JP | 03099883 | U | 4/2004 |
| KR | 20-1981-0001214 | Y1 | 9/1981 |

OTHER PUBLICATIONS

International Search Report and Written Opinion for related PCT Application No. PCT/US2013/063734, mailed on Jan. 9, 2014, in 11 pages.

* cited by examiner

*Primary Examiner* — Jerome w Donnelly

(74) *Attorney, Agent, or Firm* — Procopio, Cory, Hargreaves & Savitch LLP

(57) ABSTRACT

The present disclosure relates to an exercise training ring for use in sports such as cross-fit and gymnastics. The training ring is an annular ring of rigid material having a uniform cross-section around at least part of the ring circumference, and inner and outer annular support surfaces which are flat in the axial direction. The flat inner annular support surface forms a platform of predetermined width for supporting at least part of the palm of a user's hand when gripping the ring in a false grip.

7 Claims, 14 Drawing Sheets

EXERCISE RING WITH FALSE GRIP ASSISTANCE

RELATED APPLICATIONS

This application is a Continuation-In-Part of application Ser. No. 14/047,630 filed on Oct. 7, 2013, which claims the benefit of priority under 35 USC 119(e) of U.S. Provisional Patent Application No. 61/719,251, filed Oct. 26, 2012, and the contents of each of the aforementioned applications are incorporated herein by reference in their entirety.

BACKGROUND

1. Field of the Invention

The present disclosure relates to exercise rings for use in gymnastics and other exercises, and is particularly concerned with exercise rings which are modified or which have attachments to provide grip assistance for a user gripping the ring while performing a multitude of upper body, lower body and mid-body functional exercises.

2. Related Art

A false grip is a technique used to grab exercise rings or other exercise bars that places the wrist above the ring rather than below it. With the wrist above the ring, the transition into a support position becomes much easier. The false grip is used to achieve many skills, from the muscle-up to the iron cross. It is used in multiple sports a few of which include CrossFit, circuit training and gymnastics. The false grip improves a person's leverage by neutralizing the wrist joint and shortening their pulling radius. It also provides a more stable platform when shifting positions, such as going from hanging below the rings to supporting oneself above the rings.

When in a false grip on rings or other exercise bars, the inside of a person's wrist is hooked over the ring and then using the ring's curvature their thumb is wrapped under and around the ring to close their grip. In this position the majority of the person's weight is supported by the person's wrist and/or elbows. As a result, a significant amount of tension is placed on these joints often causing pain or injury.

The invention described herein alleviates this stress and tension by increasing the surface area of the ring resulting in better weight distribution. This distribution takes the weight off the wrist joint and elbow joint and alleviates strain and tension as well as dramatically improves the persons leverage point to transition from hanging position below the rings to support position above the rings. There are currently no devices out in the art which assist with the false grip on exercise rings for exercise bars. All other devices, which assist with the false grip or muscle up movements, are external devices that attach to the user's body as an external lifting or support aid.

SUMMARY

Provided herein are false grip assistance devices which can be used with exercise rings or other exercise equipment and exercise rings with integral false grip assistance surfaces or regions designed to increase the user's ability to maintain a false grip.

In various embodiments, the false grip device is either attached to an exercise ring or other exercise bar by way of gluing, wedging, threading, screwing, fastening, bolting, nailing, welding, suctioning, grasping, molding and fusing, or the exercise ring or exercise bar can be configured to provide integral false grip assistance surfaces or the like.

The false grip assistance device or exercise ring configuration is arranged to increase the overall surface area of the ring and/or exercise bar in order to provide an increased gripping surface area and assist users in maintaining a false grip, thus improving the purchase of the wrist joint on top of the ring. The purpose of the false grip assistance device or modified exercise ring with integral false grip assistance is to increase leverage as well as to neutralize the wrist joint and shorten the swing radius of the elbow when transitioning from below the ring to above the ring, as is common in gymnastics and exercise movements such as muscle ups.

The increased surface area for the false grip also results in a reduction of the angle at the wrist joint necessary to maintain a false grip, reducing the risk for tendon strain at the wrist and reduces the potential for medial and lateral epicondylitis at the elbow joint (tennis elbow). The chain reaction throughout the user's arm allows for more natural movement with increased leverage and power output. The instant device also allows the user's weight to be disbursed so that the pressure is not concentrated on the wrist joint or the elbow joint but is spread over the entire arm. The greater surface area of the device also disburses the athlete's weight more evenly throughout the palm, reducing the abrasive tendency common on the medial side of the wrist.

The exercise ring or gymnastics ring in one aspect is an annular ring of rigid material having a uniform cross-section around at least part of the ring circumference, and has inner and outer annular support surfaces which are "flat" in the axial direction, i.e. with no curvature in a direction parallel to the central axis of the ring. The flat inner annular support surface forms a platform of predetermined width for supporting at least part of the palm of a user's hand when gripping the ring in a false grip. In one aspect, the ring is of uniform cross-sectional shape and area around the entire circumference of the ring so that it can be gripped at any position and still provide the desired grip support. The width of the annular inner and outer support surfaces in the axial direction parallel to the central axis of the ring is in the range from one to two inches in one embodiment. This also increases the surface area available for the false grip and improves the purchase of the wrist joint on top of the ring.

Also provide herein is a progression development training ring that includes one or more stability platforms. Each stability platform can vary in length, depending on the user's preference. In some embodiments, the length of the stability platform is between about 2 inches to the length of the circumference of the ring. In specific embodiments, the length of the stability platform is between about 2 inches to about 8 inches. In some embodiments, the width of the stability platform is between about 0.25 inches to about 2 inches. In other embodiments, the width of the stability platform is tapered so that one end of the device could be 2 inches and the other end 0.25 inches. In various embodiments, each stability platform is either attached to an exercise ring or other exercise bar by way of gluing, wedging, threading, screwing, fastening, bolting, nailing, welding, suctioning, grasping, molding and fusing, or the stability platform can be manufactured as a component part of the exercise ring or exercise bar.

In a specific embodiment, the training ring has portions formed in a "box" shape and other sections which are round. This ring includes one or more stability platforms of different sizes generally formed in a box shape. In this embodiment, the larger stability platform provides increased surface area for the user to maintain a false grip. The stability platform can have a diameter of ¾ to 1¼ inches. Accordingly, the larger, thicker, stability platform is ideal for a newer user. In contrast, the smaller stability platform more closely resembles a "bare" ring making it more suitable for a more advanced user as it provides less assistance.

In this embodiment, the larger stability platform can also include a threaded insert directly under it, which can be connected to an eye bolt or spring clip. This additional connection to the ring allows a band to be attached for further assistance or to attach other training devices to the ring. This allows a user to start out on a band attached under the largest stability platform and move on to use of the ring without the band, then to the smaller stability platform and ultimately to the last part of the ring without any stability platform. Thus, this embodiment allows for the progression in development/training of one or more users on a single device.

Depending on the desire of the user, the ring can be shaped in a "round" or a "box" form. The "box" shape of the ring offers increased surface area and improved leverage for the user. In specific embodiments, the circumference of the ring is half round shaped and half box shaped. This embodiment allows a user to transition to the more difficult round area of the ring from an easier one using a single device. For example, a user can take advantage of the larger surface area on the "box" side if they like to use the false grip or they can use the traditional side if they want to use a neutral grip. There is also an inherent benefit for users who only utilize the neutral grip to "train" using the "box" shaped side as it's more difficult to perform non-false grip muscle ups on the Box side. Once the user becomes efficient on the box side, the transition back to the traditional round side is immensely easier.

Various embodiments of the devices provided herein alleviate strain and tension on the user's body and enable the user to increase their ability to perform exercises such as the muscle-up, iron cross, front levers, back levers, skin the cats, dips, handstands, forward an backward swings, backward rolls, front folls, planch holds, and variety of additional moves. The groove running the entire length of the device allows for increased purchase of the fingertips when approached from either side of the device attached to the ring. The user can enter from either the "ring" side or the "device" side to grasp the ring. Each side produces its own unique advantage. Approaching from the "ring" side allows the user to have a more authentic position with the medial wrist portion sitting atop the actual ring and using the device as additional purchase power to grasp and maintain the false grip position. Approaching from the device side would provide the additional surface area for the wrist to lie atop while the fingers clutched the ring. The finger groove is both accessible and paramount to the user from both sides for increased leverage and purchase.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

The present disclosure generally relates to a false grip assistance device and the use of this device in a multitude of upper body, lower body and mid-body functional exercises. The false grip assistance may be provided by a modified exercise ring or other exercise bar, or may be a separate grip assistance device attached to an exercise ring. In operation, the false grip assistance device or modified exercise ring assists the user in maintaining a false grip by increasing the surface area available for gripping, thus improving the purchase of the wrist joint on top of the ring. The false grip with increased surface area also neutralizes the wrist joint and shortens the swing radius of the elbow when transitioning from below the ring to above the ring, as is common in gymnastics and exercise movements with rings such as muscle ups.

Figure 1:
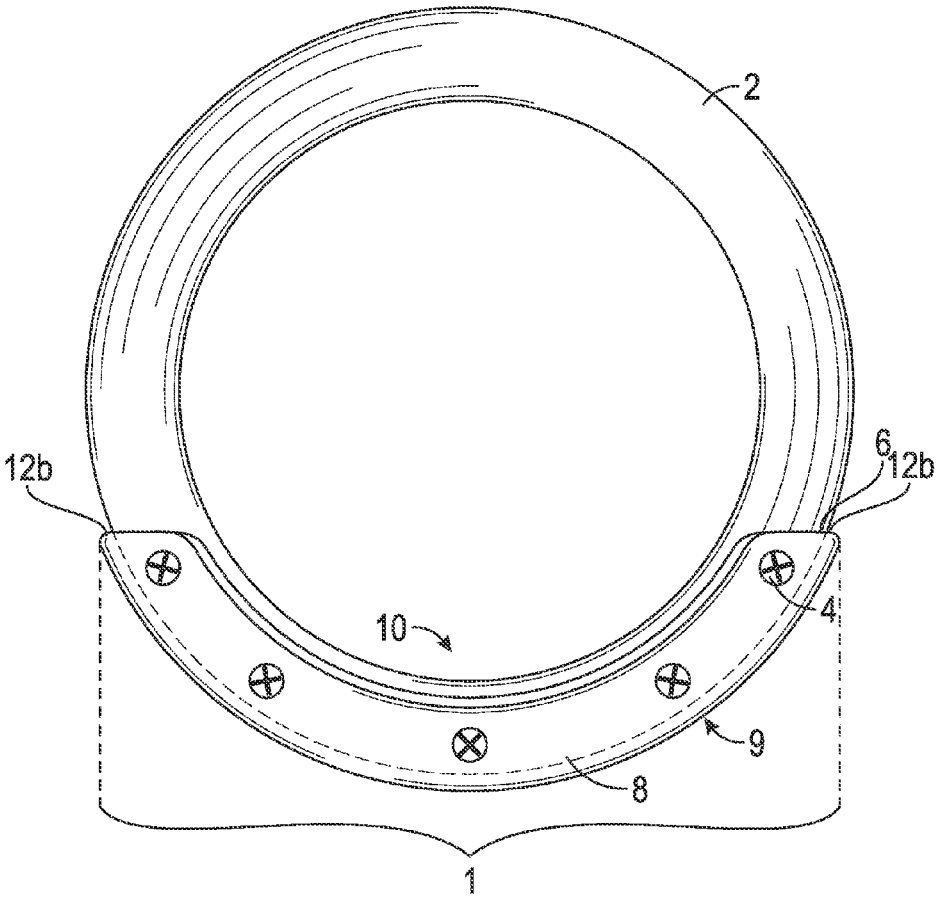
FIG. 1 illustrates a top view of one embodiment of the false grip assist device attached to a ring.

FIG. 1 illustrates one embodiment of a false grip device 1 attached to an exercise ring. This embodiment of the device comprises one or more thumb shelves 6, a front side 8, a backside 14 to connect to the ring or bar, an outside lateral side 9 an inside lateral side 10 and two distal ends 12(*a*) and 12(*b*). The device is attached to a ring 2 via various attachment means including but not limited to gluing, screwing, bolting, welding, molding, fusing and threading. In this embodiment, the device sits on one side of the ring and covers the surface area of that side. The device could also be manufactured as part of the ring. In this embodiment, screws 4 are used to attach the device 1 to the ring 2. The inside lateral side 10 is flat so that the heel of the hand can rest on the device and the ring while the outside lateral side 9 can be made with a groove 13 to allow the users fingers to grip. The groove 13 can run the length of the ring. The distal ends of the device 1 can be flat which form the thumb shelf 6. The user can rest their thumb on the thumb shelf 6 for more assistance with a muscle up or other exercise move.

Figure 2:
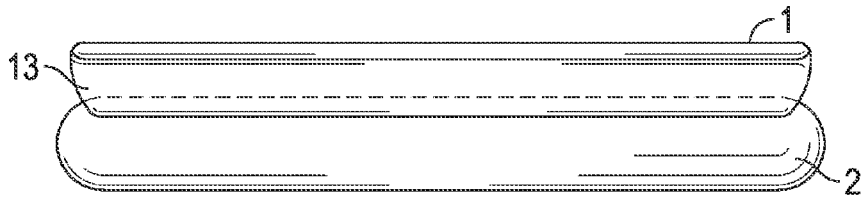
FIG. 2 illustrates a lateral view of one embodiment of the false grip assist device attached to a ring.

FIG. 2 illustrates a lateral view of one embodiment of the false grip assist device attached to a ring. As can be seen from FIG. 2, there is a groove 13 on the outside lateral portion of the device which runs its entire length. This groove 13 allows the user to get a finger hold to better grip the ring when in the false grip position. The groove provides options for the user to grip the ring on either side that of the "ring" side or the "device" side. Each side producing its own unique advantage. The groove can be in any suitable shape. In some embodiments, the groove is in the shape of an inverted semi-circle. In specific embodiments the groove has a substantially smooth surface. The groove is makes the ring more accessible and is also very important to increase the leverage and purchase.

Figure 3:
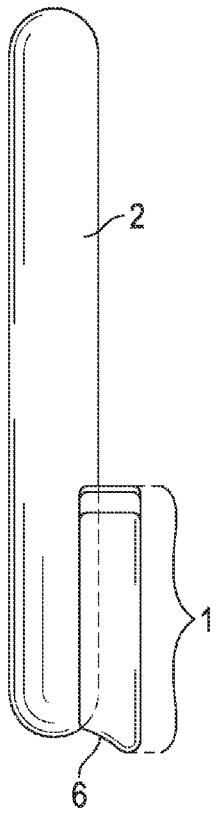
FIG. 3 illustrates a horizontal view of one embodiment of the false grip assist device attached to a ring.
Figure 4:
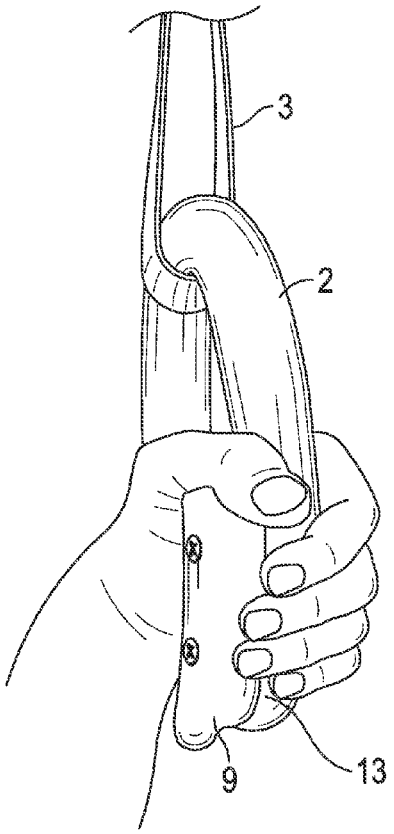
FIG. 4 illustrates one embodiment of the false grip assist device attached to a ring in use where the grip is shown.

Referring to FIG. 3, a side view of the false grip device attached to a ring can be seen. In viewing FIG. 4, the false grip device is being utilized and the user's thumb is sitting on the thumb shelf 6 while the user's fingers are wrapped around the ring 2 and resting on the inside groove 13 of the device. This grip allows the weight to be evenly distributed in the user's arms and alleviates the pressure on the wrist and joints. This reduction in stress is caused by the reduction of angle at the wrist joint necessary to maintain the false grip position. This reduced angle decreases the risk for tendon strain at the wrist and reduces the potential for medial and lateral epicondylitis at the elbow joint.

The stability platform assists in relieving tendon tension in that a false grip on a traditional ring requires not only an acute 90 degree inward flexion of the wrist but also a "twisting" or "torqueing" motion of the wrist in order to tilt the plane of the hand so that direct pressure is placed on the head of the ulna bone at the wrist joint. The stability platforms displace the wrist joint from the center of the ring by about 1 inch to 1½ inches, eliminating the need for "torqueing" the wrist. The wrist and palm can now sit flat atop the ring/stability platform with increased surface area and improved leverage in a more natural anatomical state.

Figure 5:
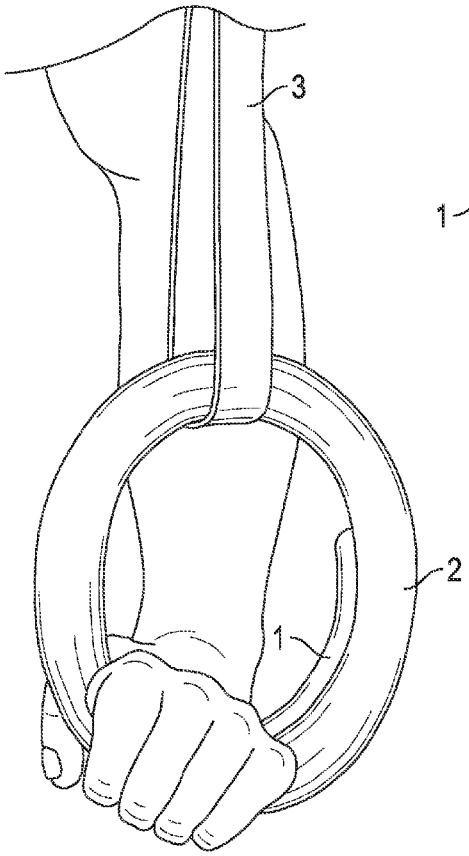
FIG. 5 illustrates one embodiment of the false grip assist device attached to a ring, where the user has their thumb on the stability platform and is holding their body vertical.

FIG. 5 illustrates a person using one embodiment of the false grip device in a push-up position. As can be seen from FIG. 5, the user has his arms extended and has his body in a vertical position. His hand is wrapped around the ring 2 and the device 1 with his thumb resting on the thumb shelf 6 (not shown) and the pad of his hand resting on the inside lateral portion of the device which is flat and extends the width of the ring, thus assisting the user in maintaining the false grip and improving the purchase of the wrist joint on top of the ring. The tips of the user's fingers are resting in the groove 13 (not shown) which extends the outer lateral side of the device 1.

Figure 6:
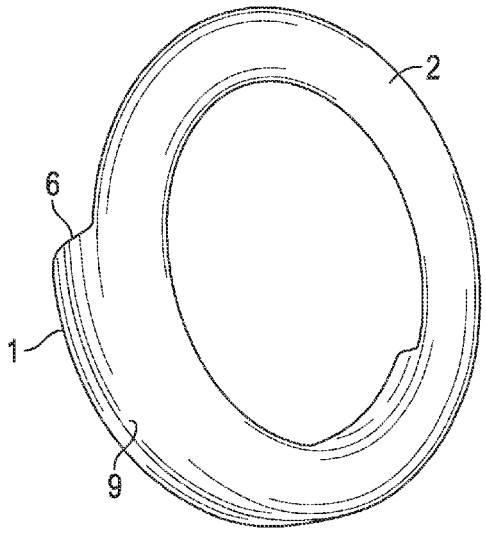
FIG. 6 illustrates a horizontal view of one embodiment of the false grip assist device that tapers in width and is attached to the finger side of a ring.
Figure 7:
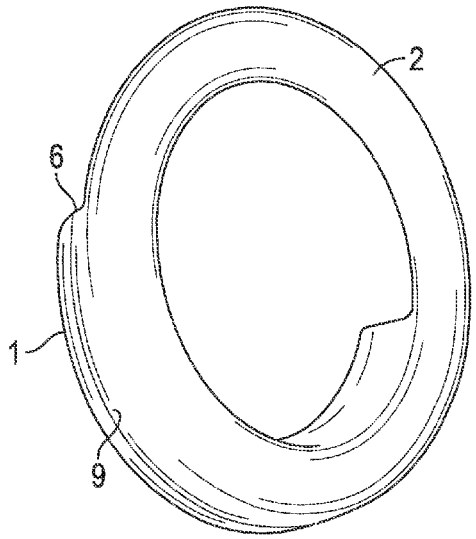
FIG. 7 illustrates a horizontal view of one embodiment of the false grip assist device that tapers in width and is attached to the finger side of a ring.

FIG. 6 and FIG. 7 show a device 1 where the width of the device 1 tapers from a thickness ranging from one-quarter to 1 inch at one distal end 12*a* and gradually climbing to a thickness of 2 inches on the other distal end 12*b*. The tapering of the device allows for users with different size hands to utilize the same device. By way of example, a user with a small hand could use thinner thickness and rest his thumb on the stability platform on that end with the smaller thickness on that end it would be easier for a user with a smaller hand to wrap his fingers around the ring and the device and place his finger tips in the groove. Conversely, a user with a larger hand would move his hands to the opposite end of the device and utilize the thicker end so that his or her thumb would rest on the thicker stability platform and his larger hand would wrap around the thicker portion of the device allowing the finger tips to rest in the groove on that far end.

In another embodiment, the device 1 can be manufactured in two or more parts. These parts could be anywhere from 1 inch to 4 inches long and placed at various distances around the ring. Breaking the device into parts would allow it to be attached to rings utilized by many different users. For example, a single false grip device can be separated into 2, 3, 4, or 5 pieces so as to allow the user to personalize and perfect the spacing of the device on the ring. For instance, a device utilized in a gymnastics studio where small children and adults come to practice on the rings. The device manufactured in many parts would allow a child to utilize one portion of the false grip device while a larger adult could utilize the thicker portion of the device. Another very important facet of both the tapered design as well as the multi-piece design besides tailoring for hand size is also the ability to utilize all portions/sizes of the device as a progression tool. The beginner user would utilize the thicker portion of the device and gradually transition to the thinner portions until ultimately weaned off of the device entirely utilizing only the ring once they have become self sufficient and gained strength on technique. The device 1 can be manufactured in various materials which would include, but are not limited to, wood, plastic, fiberglass, resin injection, molding, metal and rubber.

Figure 8:
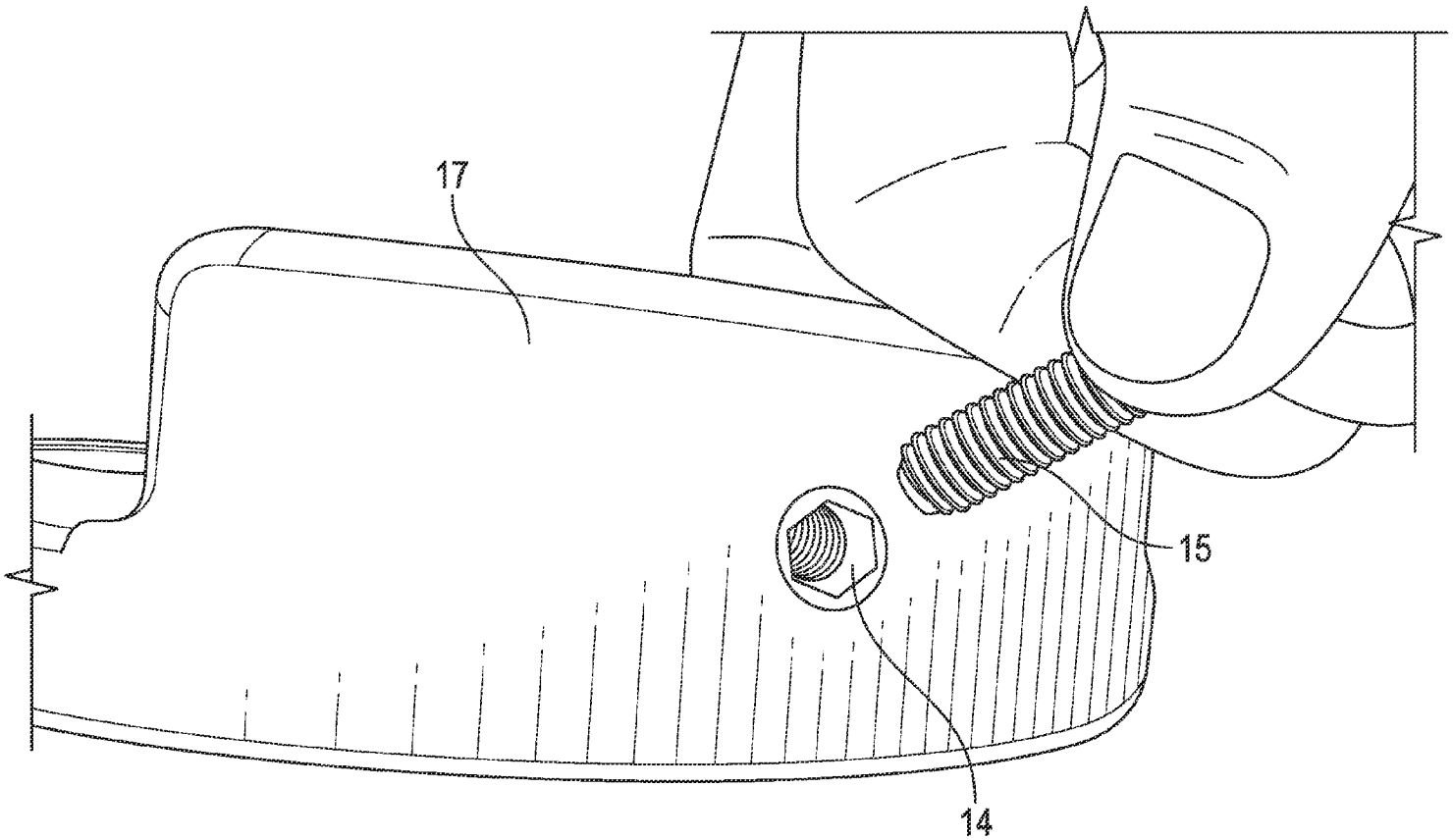
FIG. 8 illustrates a top view of one embodiment of a ring comprising a stability platform where a threaded insert is included in the stability platform allowing for the further attachment of an eye bolt or spring clip.

FIG. 8 demonstrates the attachment of a device such as an eye bolt or spring clip 15 to a threaded insert 14 in a stability platform 17 according to one embodiment. An assistance band 18 or other exercise equipment can be attached to the eyebolt or spring clip 15. This band can further assist with exercises.

Figure 9:
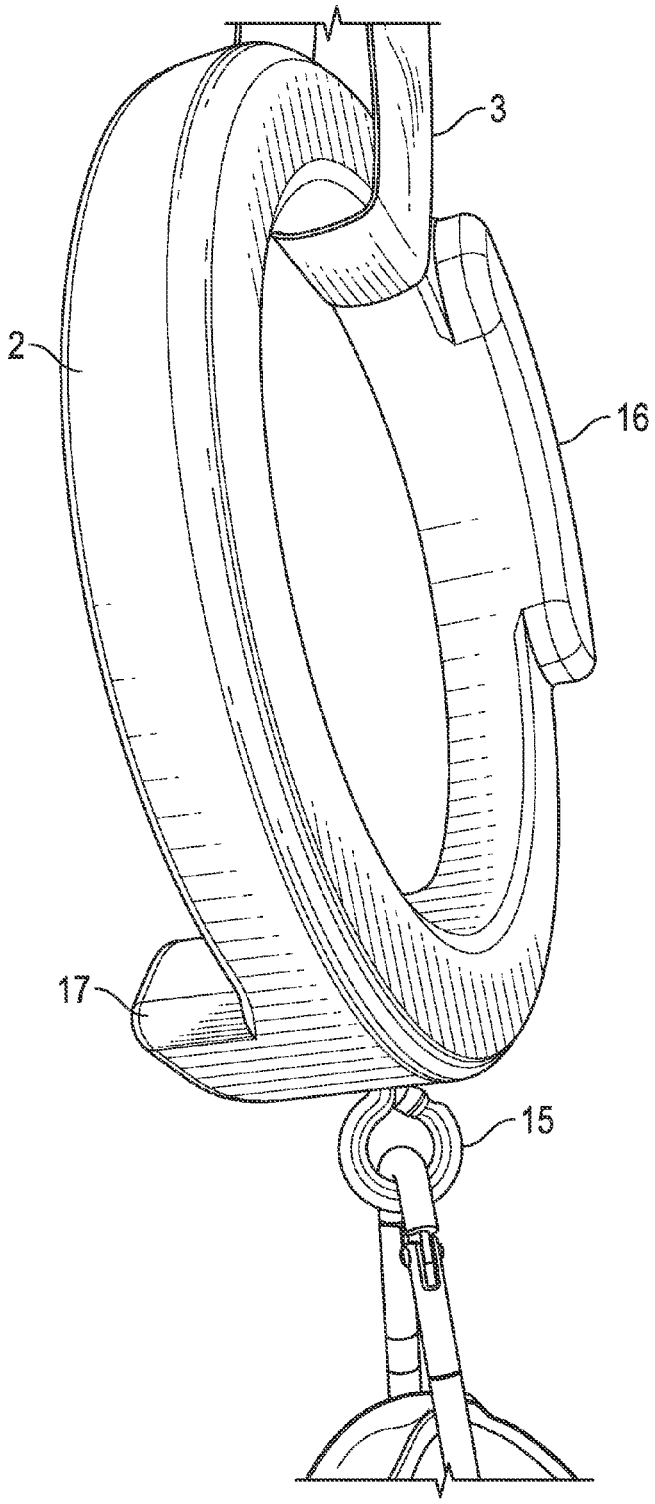
FIG. 9 illustrates a front view of one embodiment of a ring comprising two stability platforms where an eye bolt is connected to a threaded insert in the larger of the two stability platforms and a band it attached to the eye bolt to allow for further assistance.

FIG. 9 shows a perpendicular view of an embodiment of a progression development training ring. In this embodiment, the ring 2 is in a "box" shape and includes a smaller stability platform 16 and a larger stability platform 17. The larger stability platform 17 has a threaded insert directly under it (not shown) which is connected to an eye bolt (15) allowing a band to be attached for further assistance. Accordingly in this embodiment, the user can start out on the largest stability platform 17, with or without the further assistance, progress to the smaller stability platform 16 until they are ready to rotate to the last portion of the ring without any stability platform, thereby allowing for the progression in development/training on a single device. The "box" shape of the ring 2 in this embodiment also offers increased surface area and improved leverage over traditional "round" rings.

Figure 10:
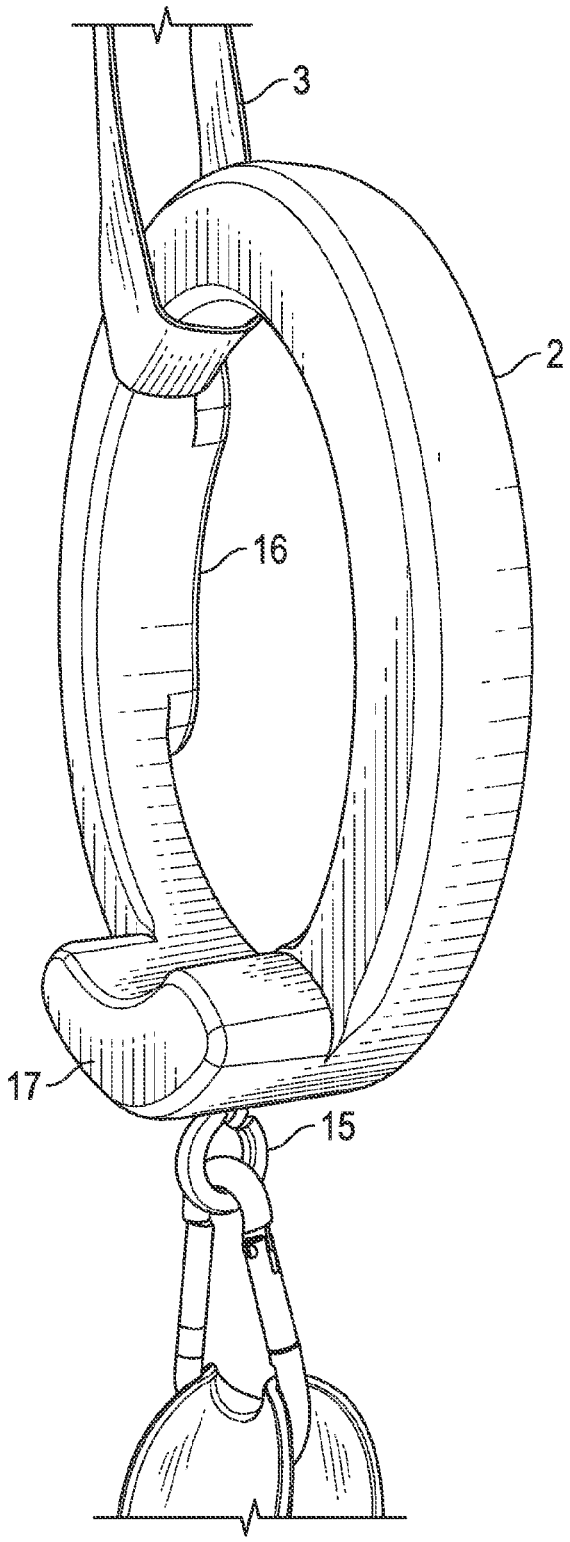
FIG. 10 illustrates a side view of one embodiment of a stability platform attached to a ring and a stability platform attached to a ring and a band for added assistance.

FIG. 10 shows a side view of an embodiment of a progression development training ring. In this embodiment, the ring 2 is in a "box" shape and includes a smaller stability platform 16 and a larger stability platform 17. The larger stability platform 17 has a threaded insert directly under it (not shown) which is connected to an eye bolt (15) allowing a band to be attached for further assistance. Accordingly in this embodiment, the user can start out on the largest stability platform 17, with our without the further assistance, progress to the smaller stability platform 16 until they are ready to rotate to the last portion of the ring without any stability platform, thereby allowing for the progression in development/training on a single device. In this embodiment, the "box" shape of the ring 2 also offers increased surface area and improved leverage over traditional "round" rings.

Figure 11:
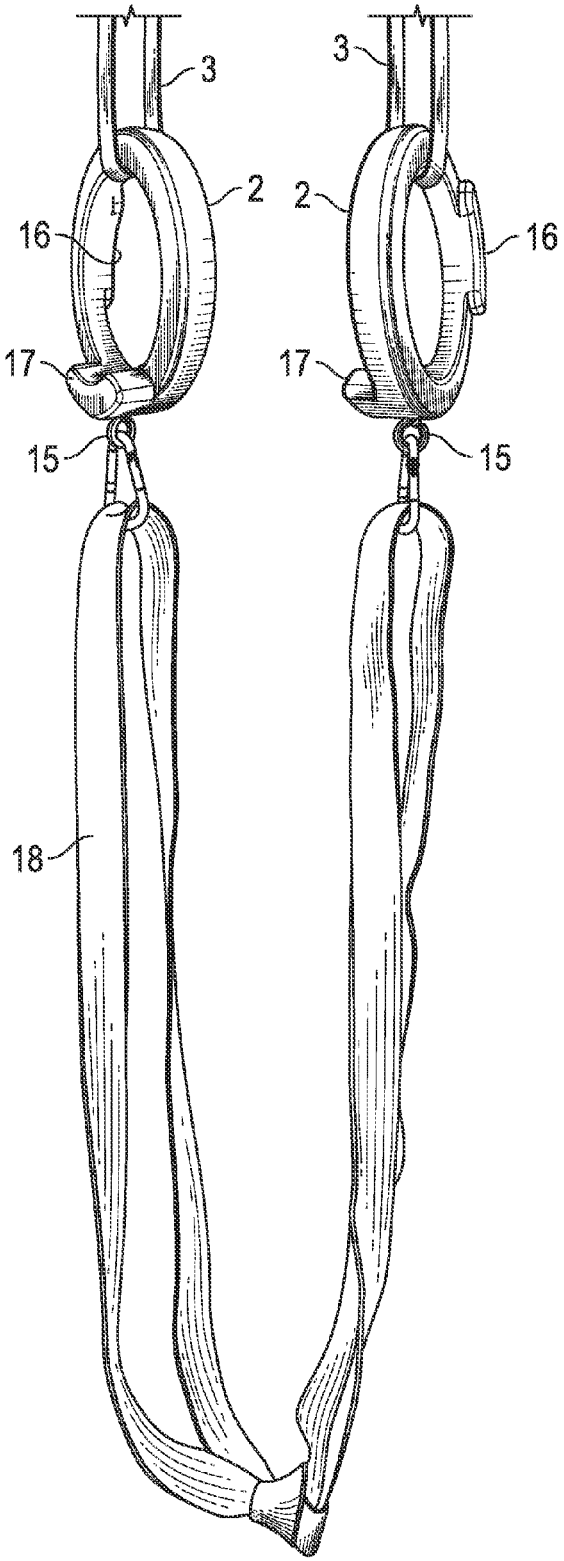
FIG. 11 illustrates a front view of an embodiment where two rings with stability platforms are connected to one another through an assistance band.
Figure 12:
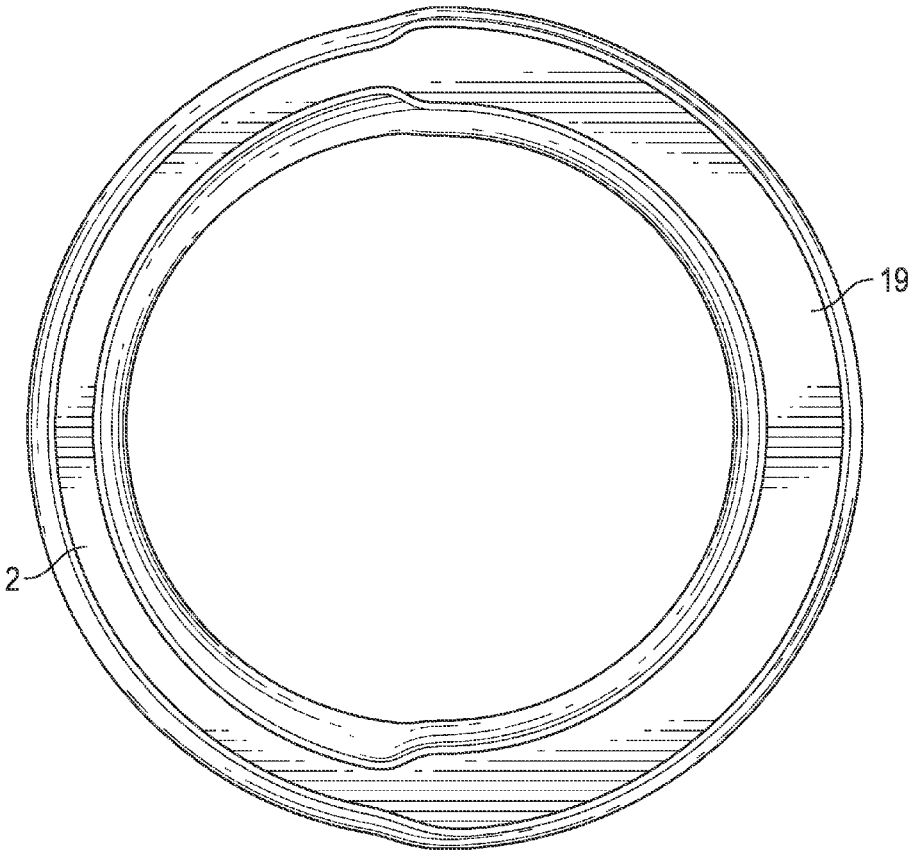
FIG. 12 illustrates a top view of an embodiment where ½ of the ring has a box shape and the other ½ of the ring has a cylinder shape.
Figure 13:
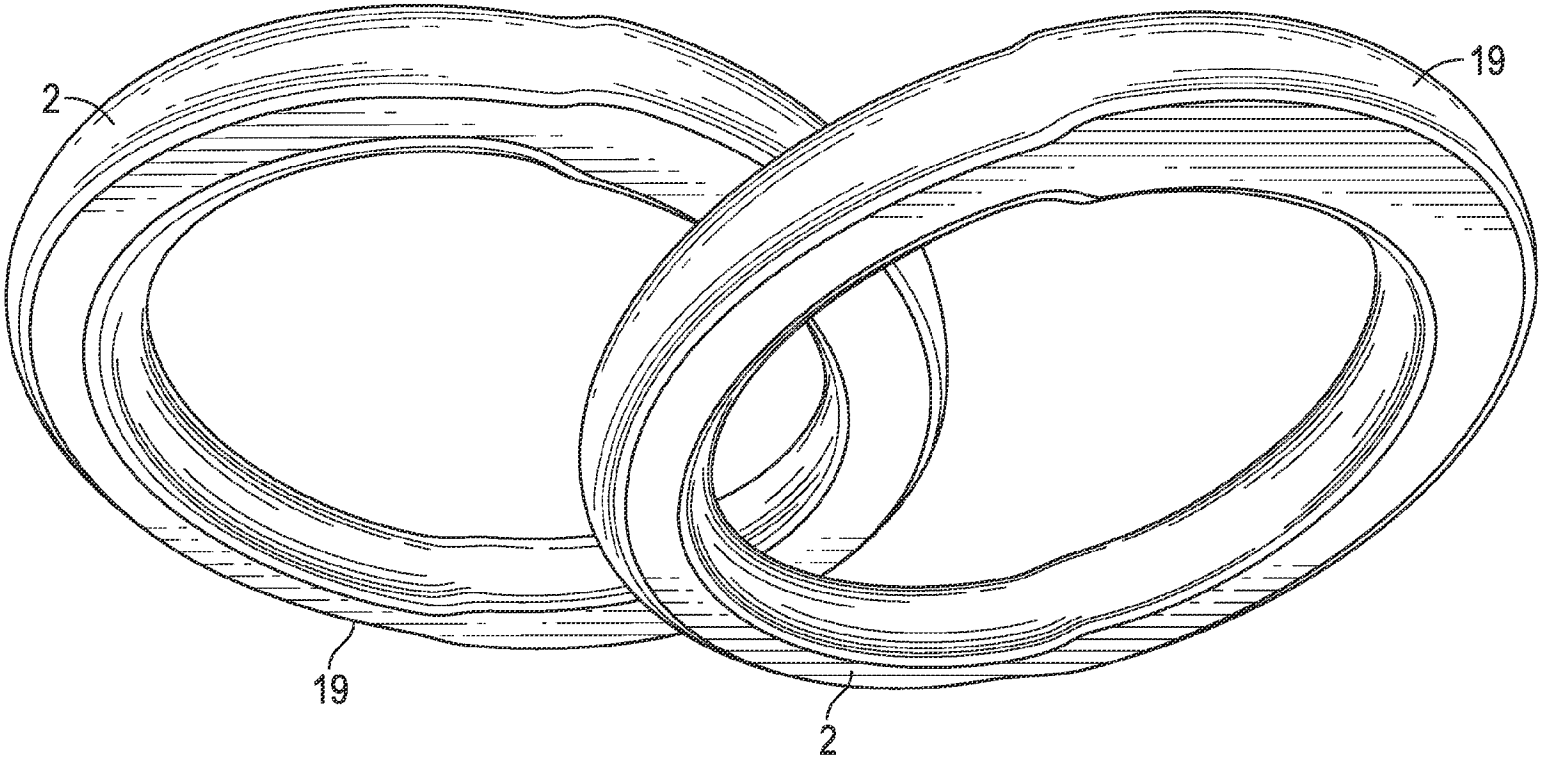
FIG. 13 illustrates side views of an embodiment where ½ of the ring has a box shape and the other ½ of the ring has a cylinder shape.

FIG. 11 shows the use of two progression development training rings together. In this embodiment, the rings 2 are in a "box" shape and include smaller stability platforms 16 and larger stability platforms 17. The larger stability platforms 17 have threaded inserts directly under them (not shown) which are connected to eye bolts 15 allowing a band 18 to connect the two progression development rings allowing for further assistance FIG. 12 and FIG. 13 show an embodiment where a box shape 19 makes up about 50% of the circumference of the ring and a cylinder shape 2 makes up the remainder of the rings circumference.

Figure 14:
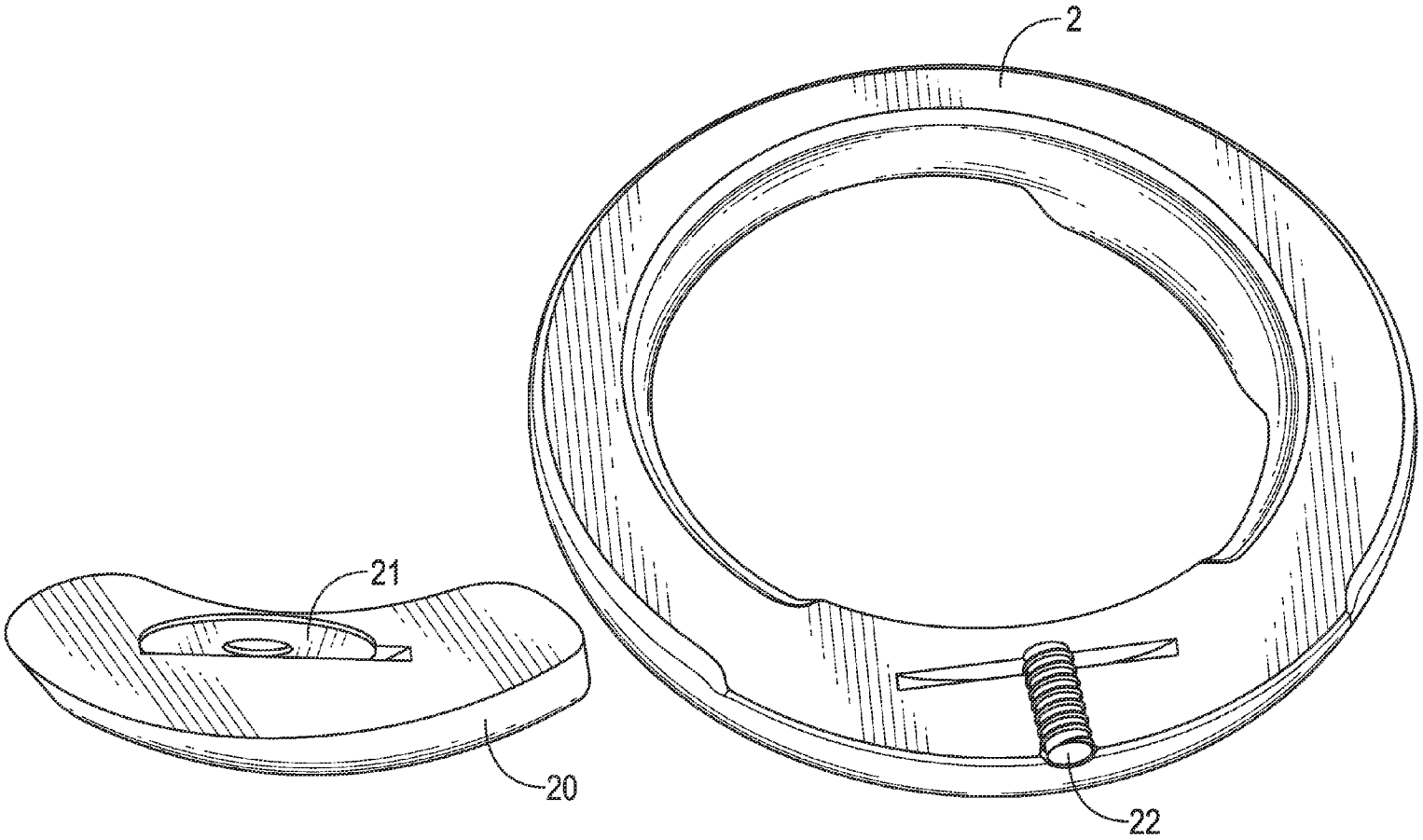
FIG. 14 illustrates a top view of one embodiment of the false grip assist device during the attachment to a ring.
Figure 15:
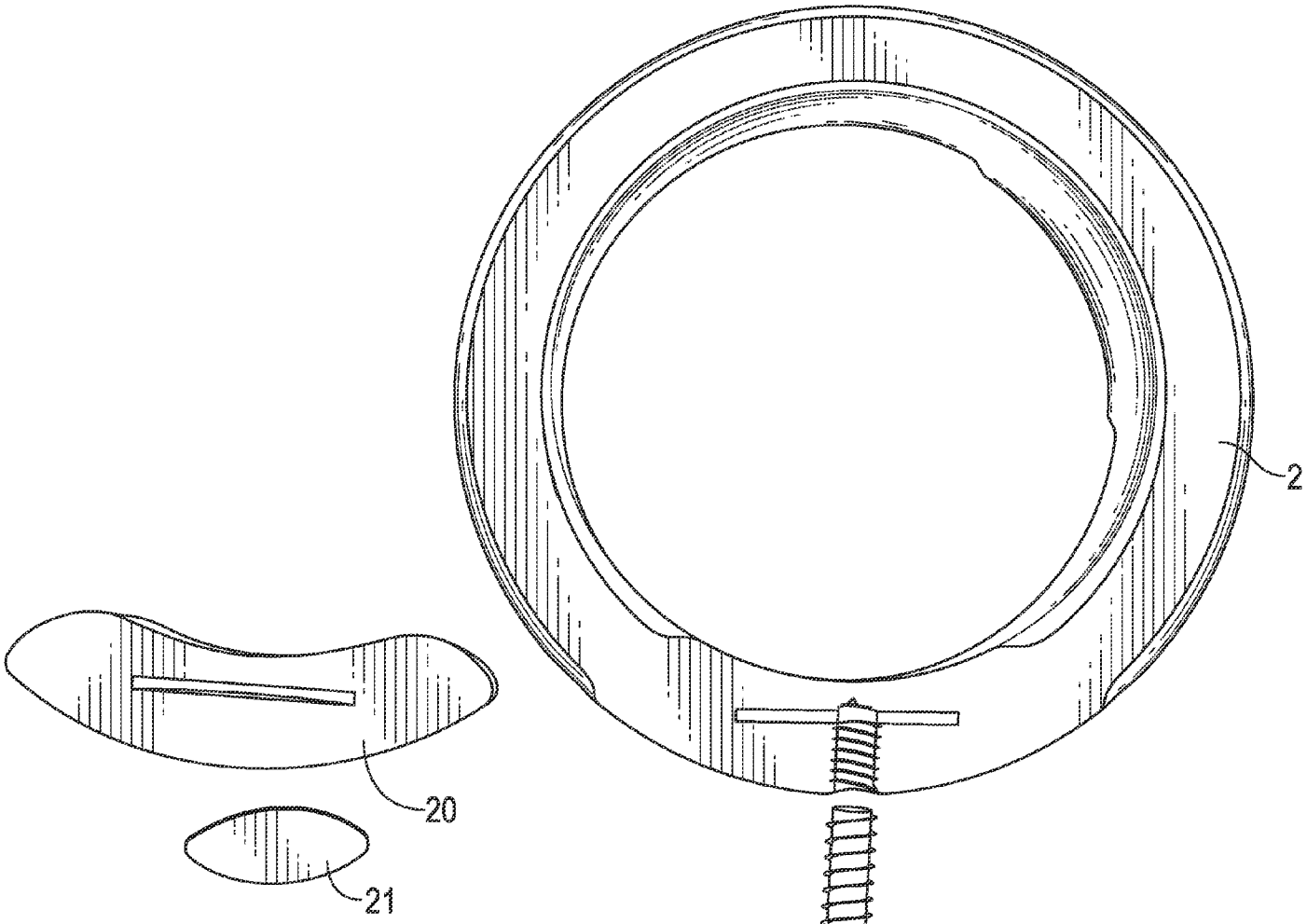
FIG. 15 illustrates a top view of one embodiment of the false grip assist device before attaching to a ring.
Figure 16:
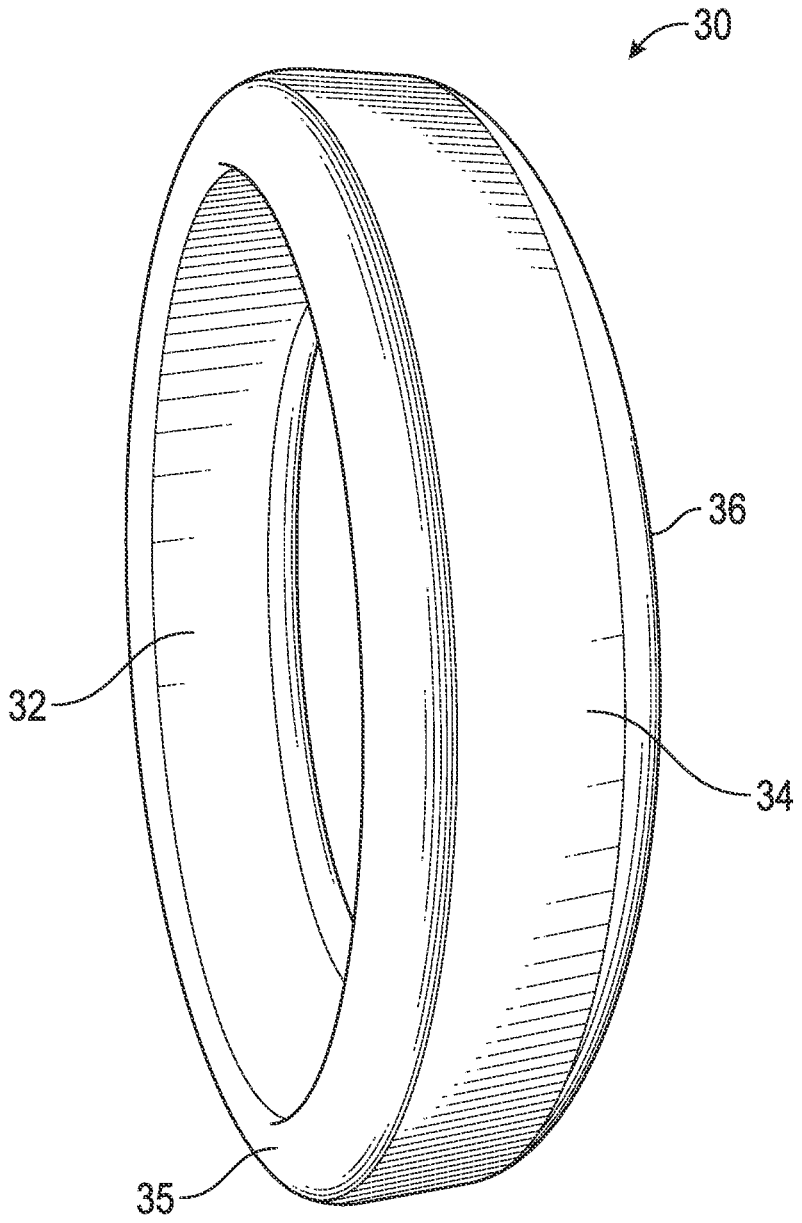
FIG. 16 is a front perspective view of an embodiment of an exercise ring of simpler construction than the embodiment of FIG. 9, with built-in or integral stability gripping surfaces.
Figure 17:
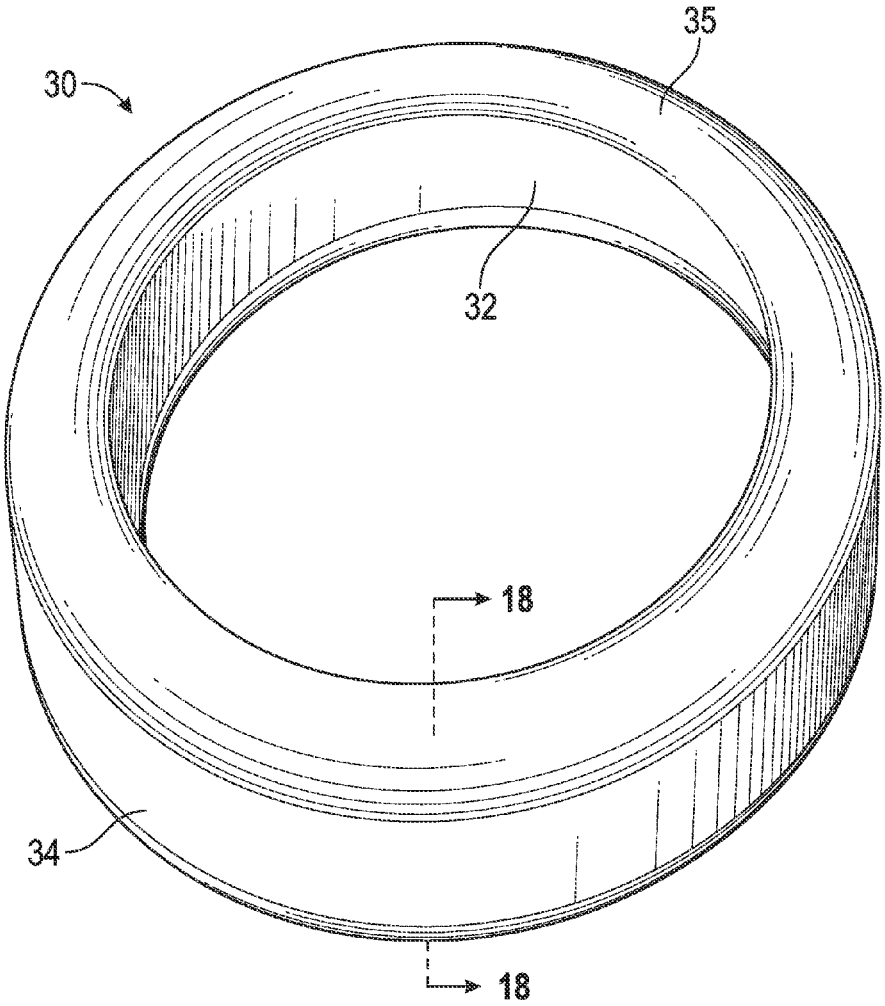
FIG. 17 is a top perspective view of the exercise ring of FIG. 16.

FIG. 14 and FIG. 15 illustrate top views of one embodiment of a stability platform 20, before attaching it to a ring 2. In this embodiment, the stability platform 20 includes a tenet 21 which is inserted into a slot on the ring 2 and attached by placing a screw 22 into a threaded insert opening on the ring (not shown). In some embodiments, the wood tenet 21 is glued into place and acts as structural support for the sheering force that is placed upon the stability platform. In this embodiment, the tenet keeps the two sides of the stability platform form 20 from shifting if the glue should fail. The hole is drilled through the tenet 21 in order to permanently place the threaded insert. Once the threaded insert is in place, the eye bolt 22 can be screwed in or removed at the user's discretion.

Figure 20:
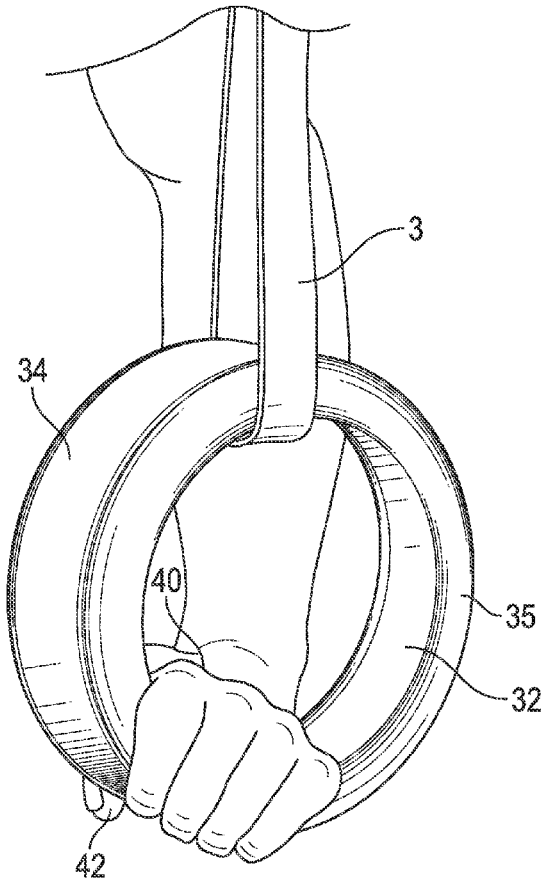
FIG. 20 illustrates the ring of FIGS. 16 to 19 suspended from a strap with a user gripping the ring with a so-called false grip with their wrist above the gripped region of the ring while holding their body vertical.

FIGS. 16 to 20 illustrate one embodiment of an exercise ring or device 30 which has an integral inner false grip assistance surface and has a uniform cross-section around the entire perimeter, unlike the rings of FIGS. 9 to 13. Ring 30 can be manufactured in various materials which include, but are not limited to, wood, plastic, fiberglass, resin injection, molding, metal and rubber. At the same time, the exercise ring has enhanced inner and outer annular support or gripping surfaces 32, 34 which provide assistance for an exerciser gripping the ring in a so-called false grip, as illustrated in FIG. 20.

Figure 18:
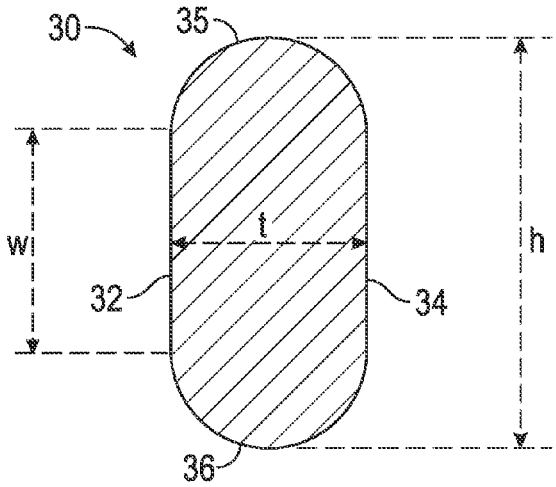
FIG. 18 is a cross-sectional view on the lines 18-18 of FIG. 17, illustrating the flat inner and outer surfaces of the ring.
Figure 19:
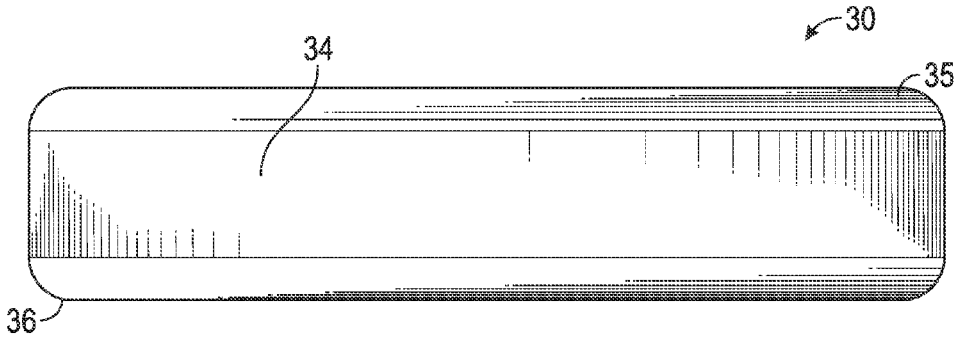
FIG. 19 is a front elevation view of the exercise ring of FIGS. 16 to 18.

As best illustrated in FIGS. 16 to 19, the inner and outer annular support surfaces 32, 34, are "flat" annular surfaces which have no curvature in the axial direction. Opposing arcuate rims 35, 36 connect inner and outer annular support surfaces 32 and 34. The "flat" inner and outer annular support surfaces are curved only around the inner and outer circumference of the ring, and are not curved in the axial direction parallel with the central axis of the ring. This forms an elongated shape in cross section with straight or flat inner and outer edges and rounded ends, as illustrated in FIG. 18, unlike conventional gymnastic rings which have a completely circular transverse cross section. Any part of the flat annular inner support surface 32 of ring 30 can form a grip or stability platform for the palm of a user's hand 40 when gripping the ring with a so called "false grip", as illustrated in FIG. 20, or in a different gripping position similar to that shown in FIG. 4.

FIG. 18 illustrates various dimensions of ring 30, specifically the width w of the "flat" inner grip support surface 32 and outer grip support surface 34, the thickness t of the ring between the annular inner and outer support surfaces, and the height h of the ring including arcuate rims 35 and 36. In one embodiment, width w of the flat inner and outer support surface is in the range from one to two inches, and in one example, width w is around 1.25 to 1.5 inches. The thickness t of the ring between the inner and outer annular support surface is around one inch. The height h of the ring including arcuate rims 35 and 36 is around two inches.

As noted above, FIG. 20 illustrates a person using the ring 30 with their arm extended and their hand 40 wrapped around part of the ring with the palm and heel of the hand resting on part of the inner flat annular support surface 32 and the finger tips (not visible) resting on one side of the outer flat annular support surface 34 while the thumb 42 rests on the opposite side of surface 34. The extended width of the inner annular support surface of the ring allows more room for the user to rest their hand, increasing the surface area available for a user to maintain the false grip and improving the purchase of the wrist joint on top of the ring, resulting in increased leverage. At the same time, the design of the ring is simple and relatively inexpensive and does not require parts to be added on or require the ring to be gripped in a specific position.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

What is claimed is:

1. An exercise training ring, comprising:

an annular ring of rigid material having an open center inside the ring, a central axis, a height in an axial direction between first and second axial ends of the ring, a circumference, the annular ring having an inner annular support surface surrounding the open center of the ring, an outer annular support surface facing outwards from the open center, and opposite first and second rims connecting the inner and outer annular support surfaces at the respective first and second axial ends of the ring;

the annular ring having a uniform cross-sectional shape around at least part of the ring circumference; and the uniform cross-sectional shape having inner and outer straight sides corresponding to the inner and outer annular support surfaces and convex arcuate ends corresponding to the first and second rims, whereby the inner and outer annular support surfaces are flat annular surfaces which have no curvature in the axial direction;

the inner annular support surface comprising a platform of predetermined width for supporting at least part of the palm of a user's hand when gripping the ring in a false grip.

2. The exercise training ring of claim 1, wherein the ring is of uniform cross-section around the entire ring circumference.

3. The exercise training ring of claim 1, wherein the inner annular support surface has a width in the axial direction in the range of about one inch to two inches.

4. The exercise training ring of claim 3, wherein the inner annular support surface has a width in the axial direction in the range of about 1.25 to 1.5 inches.

5. The exercise training ring of claim 3, wherein the outer annular support surface has a width equal to the width of the inner annular support surface.

6. The exercise training ring of claim 3, wherein the thickness of the ring between the inner and outer annular surfaces is around one inch.

7. An exercise training ring, comprising:

an annular ring of rigid material having a central axis, a height in an axial direction, a circumference and a uniform cross-section around at least part of the ring circumference;

the ring having inner and outer annular support surfaces which are flat in the axial direction and are curved only around the inner and outer circumference of the ring;

the inner annular support surface comprising a platform of predetermined width for supporting at least part of the palm of a user's hand when gripping the ring in a false grip; and the inner and outer annular support surfaces of the ring have at least one wider portion and at least one narrower portion in the axial direction, and the wider portion forms an enlarged grip support surface and extends around part of the ring circumference.

* * * * *